US009188335B2

(12) United States Patent
Uhm et al.

(10) Patent No.: US 9,188,335 B2
(45) Date of Patent: Nov. 17, 2015

(54) SYSTEM AND METHOD FOR REDUCING COMBUSTION DYNAMICS AND $NO_x$ IN A COMBUSTOR

(75) Inventors: Jong Ho Uhm, Simpsonville, SC (US); Thomas Edward Johnson, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1057 days.

(21) Appl. No.: 13/281,528

(22) Filed: Oct. 26, 2011

(65) Prior Publication Data

US 2013/0104556 A1 May 2, 2013

(51) Int. Cl.

| | |
|---|---|
| ***F23R 3/02*** | (2006.01) |
| ***F23R 3/28*** | (2006.01) |
| ***F23L 7/00*** | (2006.01) |
| ***F23R 3/00*** | (2006.01) |
| ***F23M 20/00*** | (2014.01) |

(52) U.S. Cl.

CPC ..... *F23R 3/002* (2013.01); *F23L 7/005* (2013.01); *F23M 20/005* (2015.01); *F23R 3/283* (2013.01); *F23D 2900/00018* (2013.01); *F23L 2900/07002* (2013.01); *F23R 2900/00014* (2013.01)

(58) Field of Classification Search

CPC ..... F23R 3/002; F23R 3/283; F23R 2900/00014; F23D 2900/00018; F23L 7/005; F23L 2900/07002; F23M 20/005

USPC ..... 60/737, 738, 740, 742, 746, 747

See application file for complete search history.

(56) References Cited

U.S. PATENT DOCUMENTS

| | | | | |
|---|---|---|---|---|
| 3,771,500 | A | | 11/1973 | Shakiba |
| 4,100,733 | A | * | 7/1978 | Striebel et al. ..... 60/39.463 |
| 4,104,873 | A | | 8/1978 | Coffinberry |
| 4,412,414 | A | | 11/1983 | Novick et al. |
| 5,104,310 | A | | 4/1992 | Saltin |
| 5,205,120 | A | | 4/1993 | Obländer et al. |
| 5,213,494 | A | | 5/1993 | Jeppesen |
| 5,235,814 | A | * | 8/1993 | Leonard ..... 60/738 |
| 5,341,645 | A | | 8/1994 | Ansart et al. |
| 5,439,532 | A | | 8/1995 | Fraas |
| 5,592,819 | A | | 1/1997 | Ansart et al. |
| 5,707,591 | A | | 1/1998 | Semedard et al. |
| 5,836,164 | A | * | 11/1998 | Tsukahara et al. ..... 60/733 |
| 5,927,076 | A | * | 7/1999 | Pillsbury ..... 60/738 |
| 6,098,407 | A | | 8/2000 | Korzendorfer et al. |
| 6,123,542 | A | | 9/2000 | Joshi et al. |

(Continued)

*Primary Examiner* — William H Rodriguez
*Assistant Examiner* — Carlos A Rivera
(74) *Attorney, Agent, or Firm* — Dority & Manning, PA

(57) ABSTRACT

A system for reducing combustion dynamics and $NO_x$ in a combustor includes a tube bundle that extends radially across at least a portion of the combustor, wherein the tube bundle comprises an upstream surface axially separated from a downstream surface. A shroud circumferentially surrounds the upstream and downstream surfaces. A plurality of tubes extends through the tube bundle from the upstream surface through the downstream surface, wherein the downstream surface is stepped to produce tubes having different lengths through the tube bundle. A method for reducing combustion dynamics and $NO_x$ in a combustor includes flowing a working fluid through a plurality of tubes radially arranged between an upstream surface and a downstream surface of an end cap that extends radially across at least a portion of the combustor, wherein the downstream surface is stepped.

18 Claims, 7 Drawing Sheets

(56) References Cited

U.S. PATENT DOCUMENTS

| | | | | |
|---|---|---|---|---|
| 6,165,600 | A * | 12/2000 | Ivkovich et al. | 428/213 |
| 6,394,791 | B2 | 5/2002 | Smith et al. | |
| 6,438,961 | B2 | 8/2002 | Tuthill et al. | |
| 6,796,790 | B2 | 9/2004 | Venizelos et al. | |
| 6,983,600 | B1 | 1/2006 | Dinu et al. | |
| 7,003,958 | B2 | 2/2006 | Dinu et al. | |
| 7,007,478 | B2 | 3/2006 | Dinu | |
| 7,631,499 | B2 | 12/2009 | Bland | |
| 7,752,850 | B2 | 7/2010 | Laster et al. | |
| 8,322,143 | B2 * | 12/2012 | Uhm et al. | 60/737 |
| 2004/0216463 | A1 | 11/2004 | Harris | |
| 2008/0016876 | A1 | 1/2008 | Colibaba-Evulet et al. | |
| 2008/0053097 | A1 * | 3/2008 | Han et al. | 60/737 |
| 2008/0268387 | A1 * | 10/2008 | Saito et al. | 431/8 |
| 2008/0304958 | A1 | 12/2008 | Norris et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 | 1/2011 | Kraemer et al. | |
| 2011/0067404 | A1 * | 3/2011 | Johnson et al. | 60/747 |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |
| 2012/0006033 | A1 * | 1/2012 | Kim et al. | 60/772 |
| 2012/0180487 | A1 * | 7/2012 | Uhm et al. | 60/737 |
| 2014/0157779 | A1 * | 6/2014 | Uhm et al. | 60/725 |

* cited by examiner

SYSTEM AND METHOD FOR REDUCING COMBUSTION DYNAMICS AND $NO_x$ IN A COMBUSTOR

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a system and method for reducing combustion dynamics and $NO_x$ in a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, a plurality of premixer tubes may be radially arranged in an end cap to provide fluid communication for the working fluid and fuel through the end cap and into the combustion chamber. Although effective at enabling higher operating temperatures while protecting against flashback or flame holding and controlling undesirable emissions, some fuels and operating conditions produce very high frequencies with high hydrogen fuel composition in the combustor. Increased vibrations in the combustor associated with high frequencies may reduce the useful life of one or more combustor components. Alternately, or in addition, high frequencies of combustion dynamics may produce pressure pulses inside the premixer tubes and/or combustion chamber that affect the stability of the combustion flame, reduce the design margins for flashback or flame holding, and/or increase undesirable emissions. Therefore, a system and method that reduces resonant frequencies in the combustor would be useful to enhancing the thermodynamic efficiency of the combustor, protecting the combustor from catastrophic damage, and/or reducing undesirable emissions over a wide range of combustor operating levels.

BRIEF DESCRIPTION OF THE INVENTION

Aspects and advantages of the invention are set forth below in the following description, or may be obvious from the description, or may be learned through practice of the invention.

One embodiment of the present invention is a system for reducing combustion dynamics and $NO_x$ in a combustor. The system includes a tube bundle that extends radially across at least a portion of the combustor, wherein the tube bundle comprises an upstream surface axially separated from a downstream surface. A shroud circumferentially surrounds the upstream and downstream surfaces. A plurality of tubes extends through the tube bundle from the upstream surface through the downstream surface, wherein the downstream surface is stepped to prevent flame interaction between tubes and to produce tubes having different lengths through the tube bundle.

Another embodiment of the present invention is a system for reducing combustion dynamics and $NO_x$ in a combustor that includes an end cap that extends radially across at least a portion of the combustor, wherein the end cap comprises an upstream surface and a stepped downstream surface axially separated from the upstream surface. A cap shield circumferentially surrounds the upstream and downstream surfaces. A plurality of tubes extends through the end cap from the upstream surface through the stepped downstream surface.

The present invention may also include a method for reducing combustion dynamics and $NO_x$ in a combustor. The method includes flowing a working fluid through a plurality of tubes radially arranged between an upstream surface and a downstream surface of an end cap that extends radially across at least a portion of the combustor, wherein the downstream surface is stepped.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
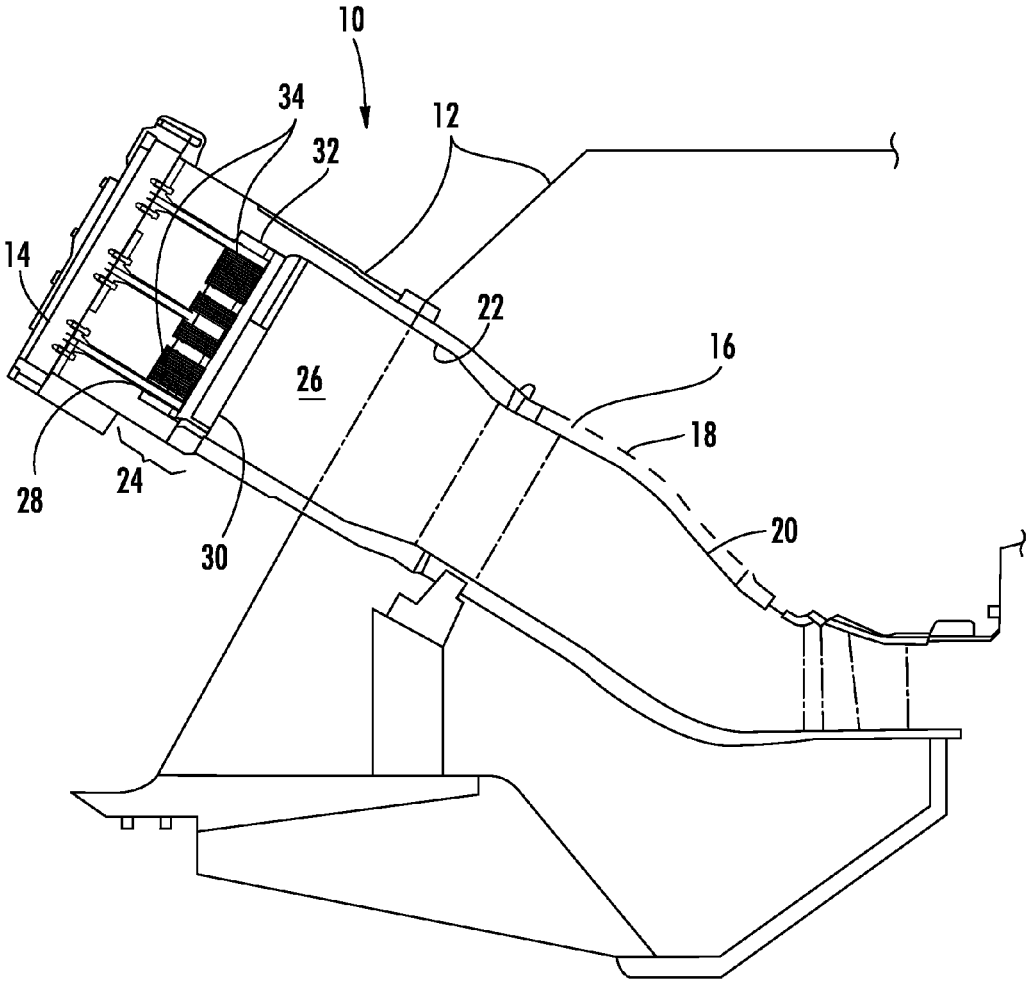
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for reducing combustion dynamics and $NO_x$ in a combustor. In particular embodiments, a plurality of tubes having different lengths with a downstream step surface are radially arranged across an end cap in one or more tube bundles. The different tube lengths decouple the natural frequency of the combustion dynamics, reduce flow instabilities, and/or axially distribute the combustion flame across a downstream surface of the end cap to reduce NOx production. Alternately or in addition, the downstream surface of the end cap may include a thermal barrier coating, diluent passages, and/or tube protrusions that individually or collectively further cool the downstream surface, reduce flow instabilities, and/or axially distribute the combustion flame. As a result, various embodiments of the present invention may allow extended combustor operating conditions, extend the life and/or maintenance intervals for various combustor components, maintain adequate design margins of flashback or flame holding, and/or reduce undesirable emissions. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section of an exemplary combustor 10, such as would be included in a gas turbine, according to one embodiment of the present invention. A casing 12 and an end cover 14 may surround the combustor 10 to contain a working fluid flowing to the combustor 10. The working fluid passes through flow holes 16 in an impingement sleeve 18 to flow along the outside of a transition piece 20 and liner 22 to provide convective cooling to the transition piece 20 and liner 22. When the working fluid reaches the end cover 14, the working fluid reverses direction to flow through an end cap 24 into a combustion chamber 26.

The end cap 24 extends radially across at least a portion of the combustor 10 and generally includes an upstream surface 28 and a downstream surface 30 axially separated from the upstream surface 28. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A. A cap shield 32 circumferentially surrounds the upstream and downstream surfaces 28, 30 to define one or more fluid plenums inside the end cap 24 between the upstream and downstream surfaces 28, 30. A plurality of tubes 34 extends through the end cap 24 from the upstream surface 28 through the downstream surface 30 to provide fluid communication through the end cap 24 to the combustion chamber 26.

Figure 2:
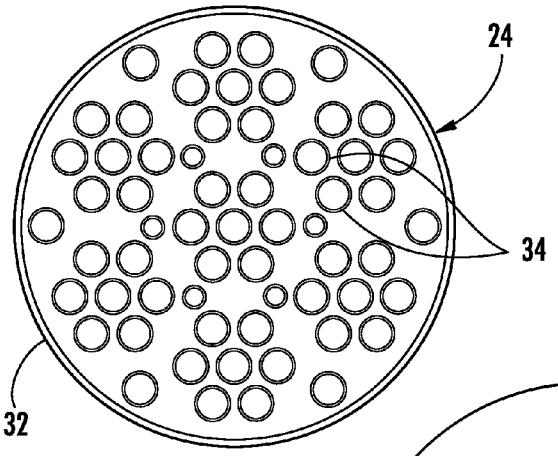
FIG. 2 is an upstream axial view of the end cap shown in FIG. 1 according to an embodiment of the present invention.
Figure 3:
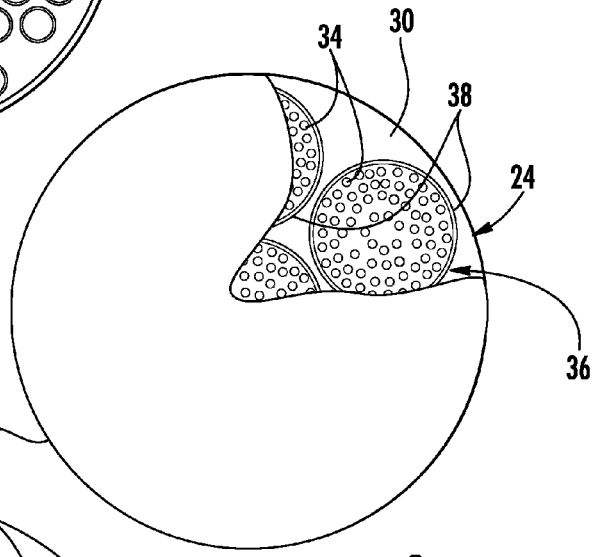
FIG. 3 is an upstream axial view of the end cap shown in FIG. 1 according to an alternate embodiment of the present invention.
Figure 4:
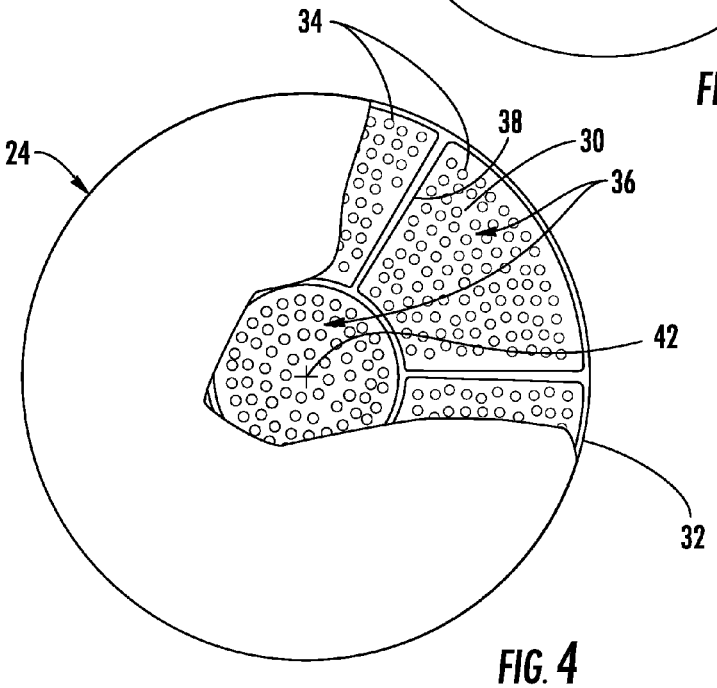
FIG. 4 is an upstream axial view of the end cap shown in FIG. 1 according to an alternate embodiment of the present invention.

Various embodiments of the combustor 10 may include different numbers and arrangements of the tubes 34, and FIGS. 2, 3, and 4 provide upstream views of various arrangements of the tubes 34 in the end cap 24 within the scope of the present invention. Although shown as cylindrical tubes in each embodiment, the cross-section of the tubes 34 may be any geometric shape, and the present invention is not limited to any particular cross-section unless specifically recited in the claims. The tubes 34 may be radially arranged across the entire end cap 24, as shown in FIG. 2. Alternately, as shown in FIGS. 3 and 4, the tubes 34 may be arranged in circular, triangular, square, oval, or virtually any shape of tube bundles 36, with each tube bundle 36 generally defined by the upstream and downstream surfaces 28, 30 of the end cap 24 and a shroud 38 that circumferentially surrounds the upstream and downstream surfaces 28, 30 to define one or more fluid plenums inside the tube bundle 36 between the upstream and downstream surfaces 28, 30. The tube bundles 36 may be radially arranged in the end cap 24 in various geometries. For example, the tube bundles 36 may be arranged as six tube bundles 36 surrounding a single tube bundle 36, as shown in FIG. 3. Alternately, as shown in FIG. 4, five pie-shaped tube bundles 36 may be arranged around or adjacent to a single tube bundle 36 aligned with an axial centerline 42 of the end cap 24.

Figure 5:
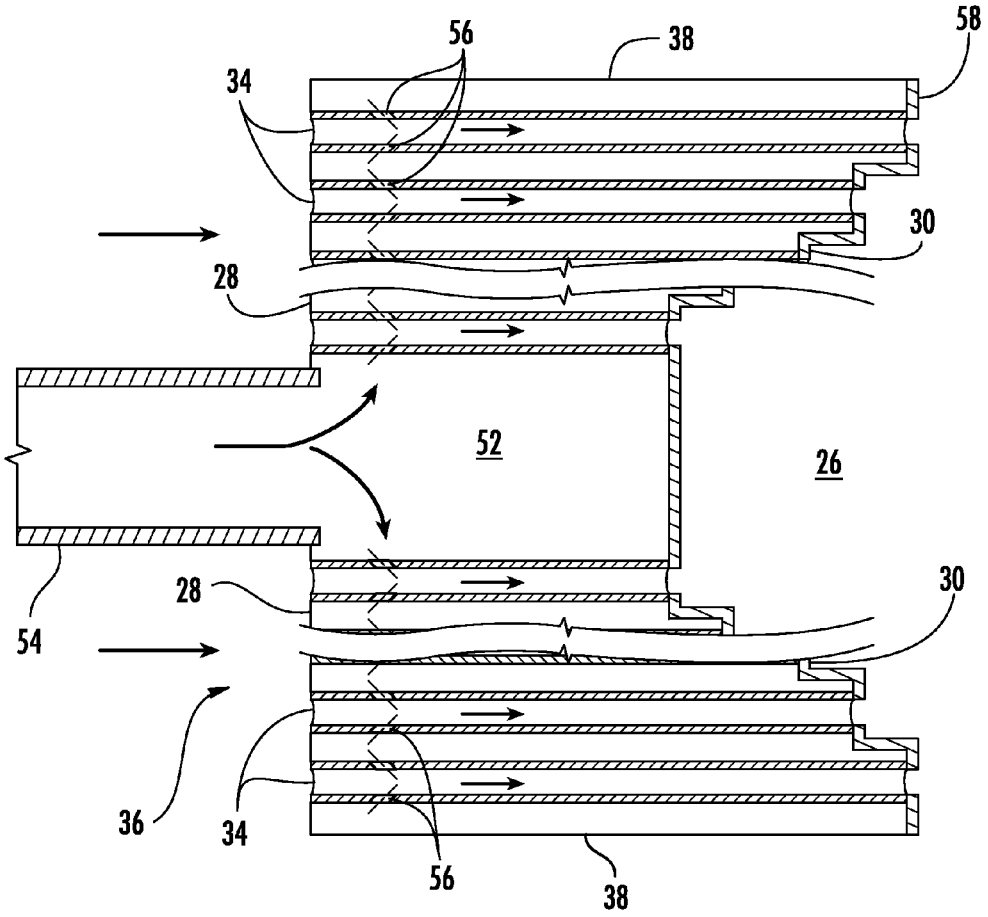
FIG. 5 is an enlarged cross-section view of a tube bundle according to a first embodiment of the present invention.
Figure 6:
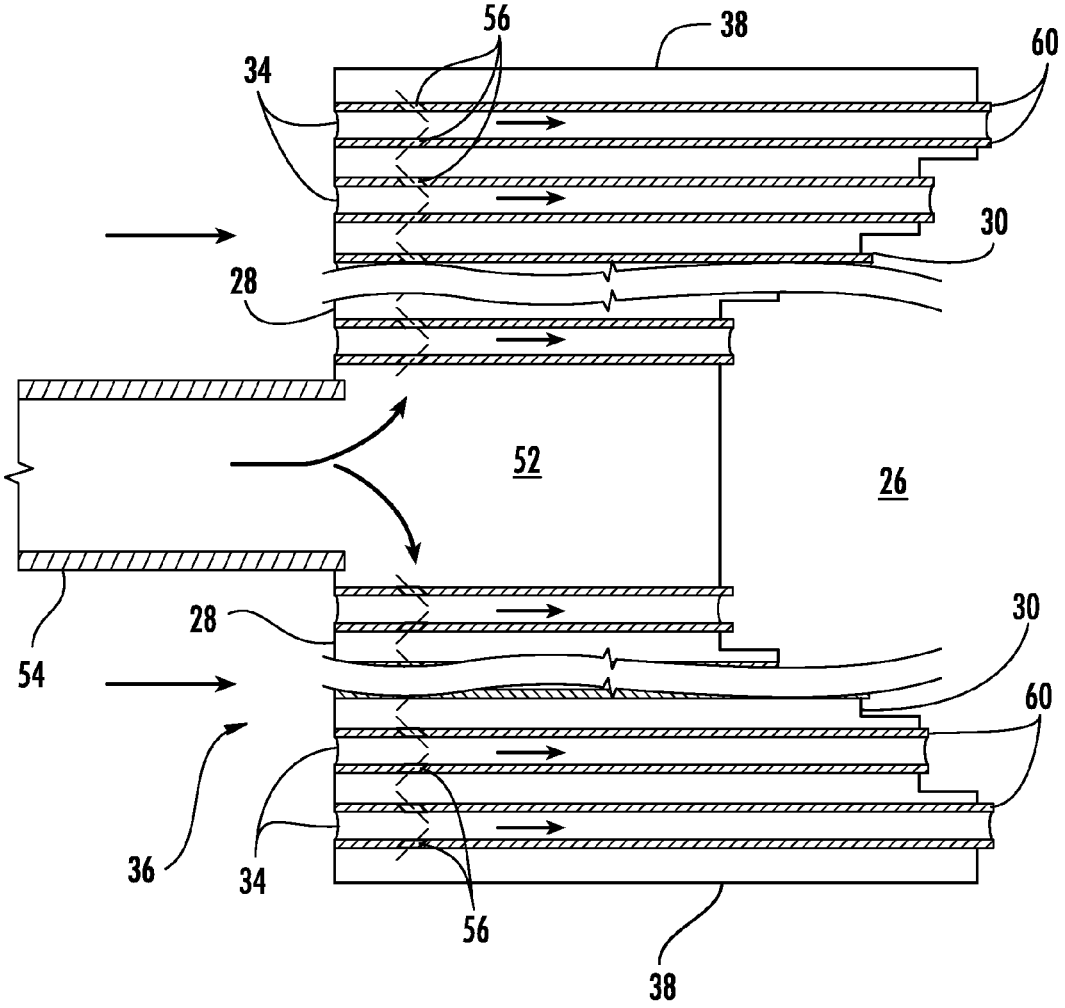
FIG. 6 is an enlarged cross-section view of a tube bundle according to a second embodiment of the present invention.
Figure 7:
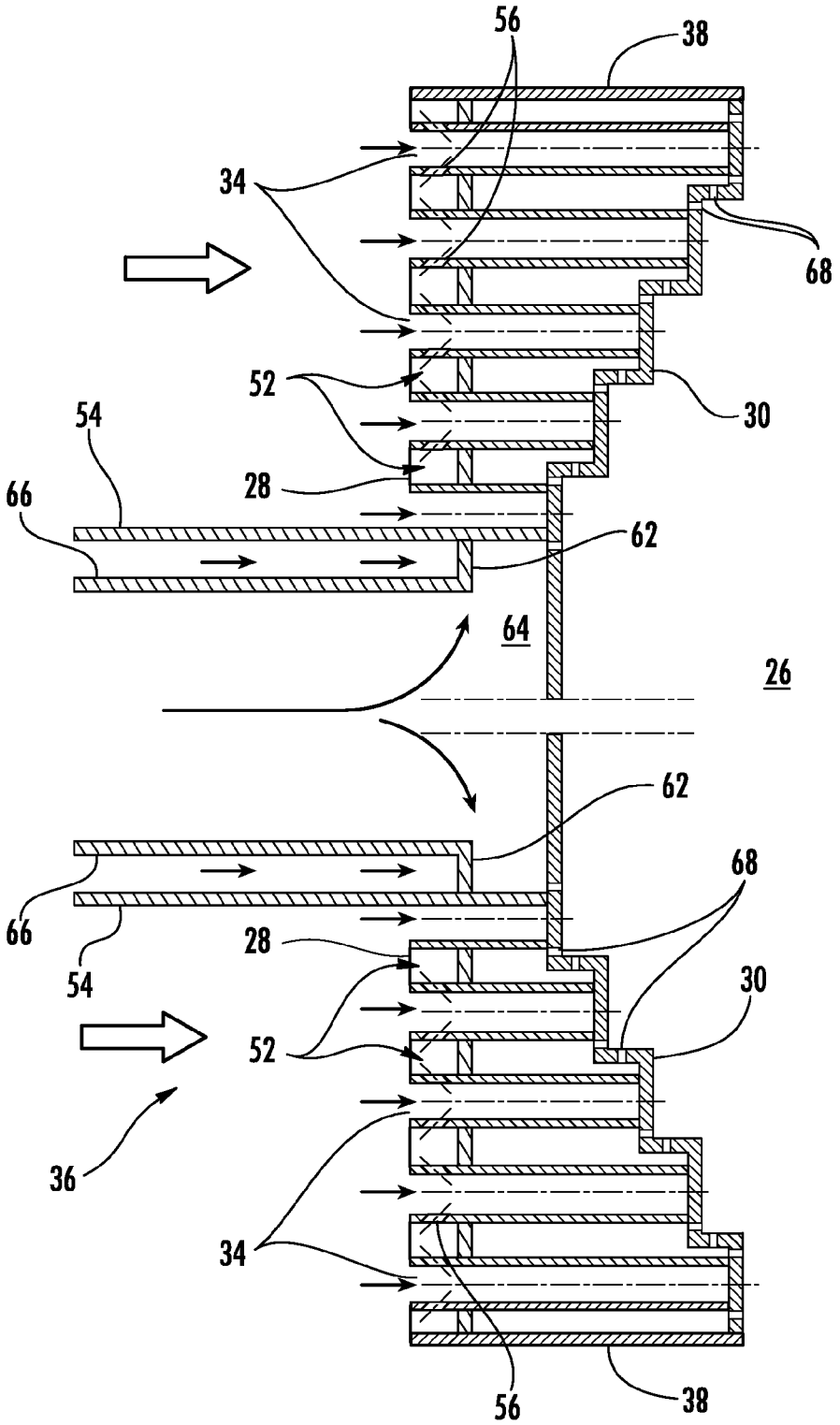
FIG. 7 is an enlarged cross-section view of a tube bundle according to a third embodiment of the present invention.
Figure 8:
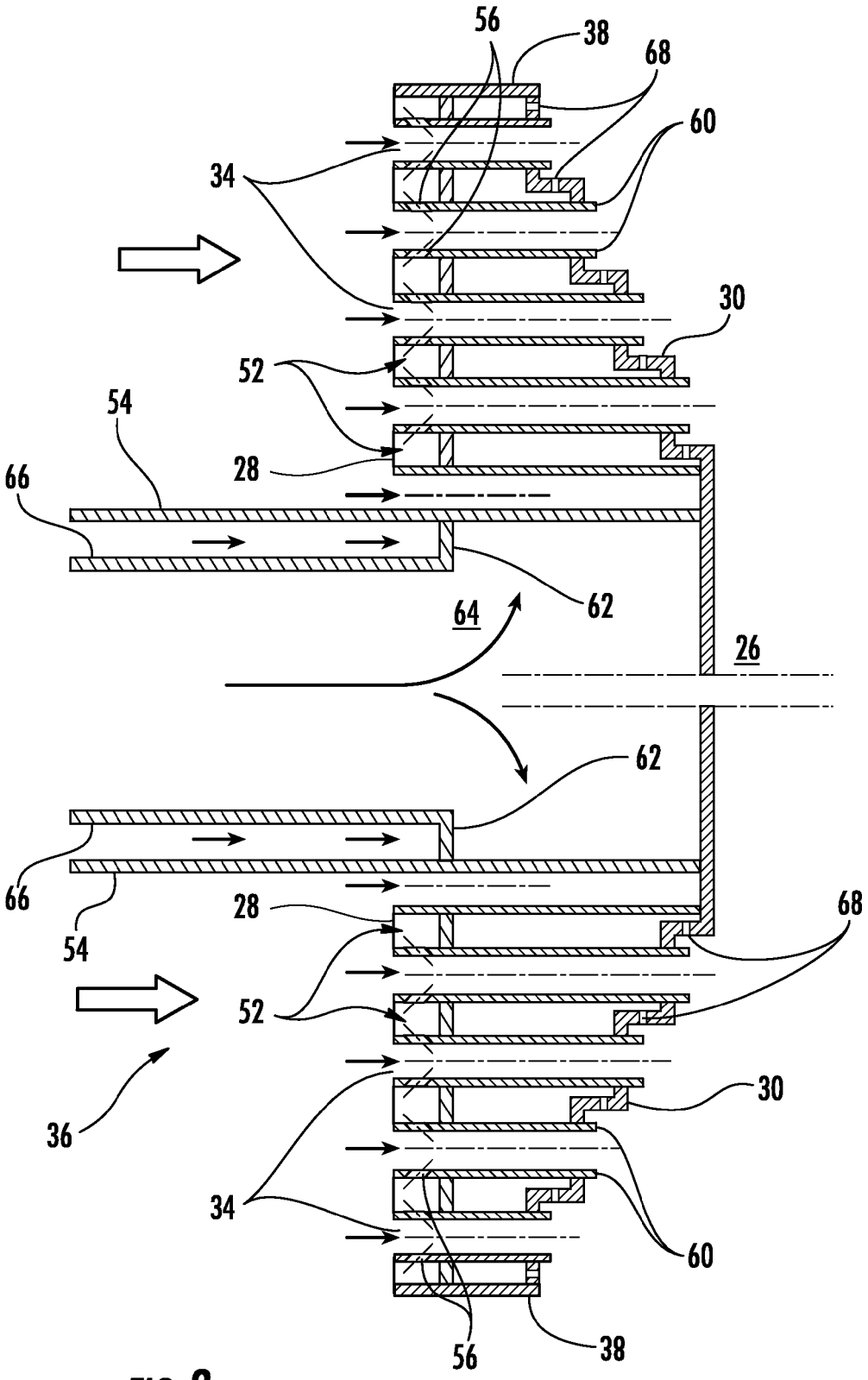
FIG. 8 is an enlarged cross-section view of a tube bundle according to a fourth embodiment of the present invention.
Figure 9:
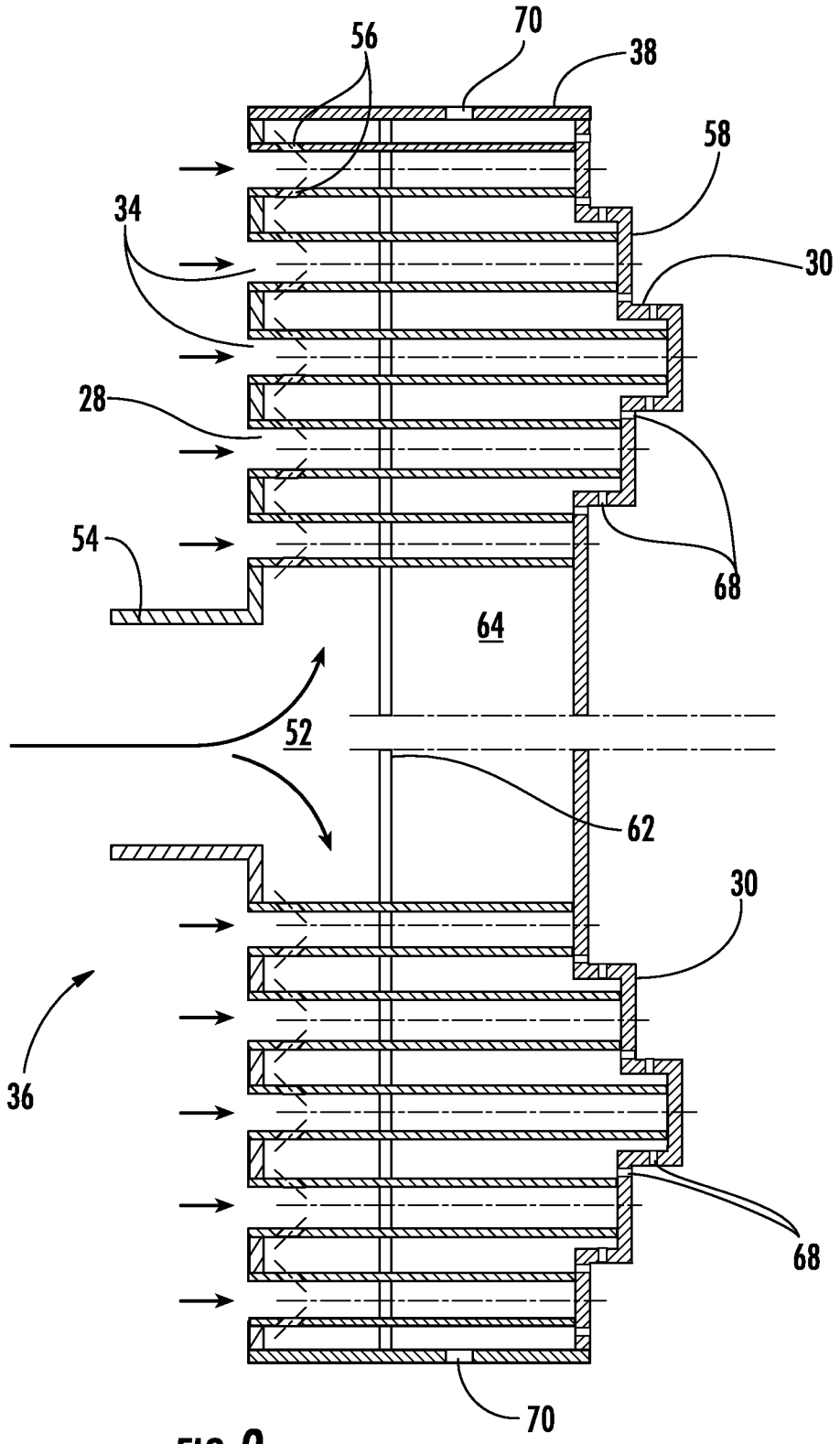
FIG. 9 is an enlarged cross-section view of a tube bundle according to a fifth embodiment of the present invention.

FIGS. 5-9 provide enlarged cross-section views of tube bundles 36 according to various embodiments of the present invention. In each embodiment, the upstream surface 28 is generally flat or straight and oriented perpendicular to the general flow of the working fluid. In contrast, the downstream surface 30 is stepped radially across the tube bundle 36 and/or end cap 24, creating different axial lengths of the tubes 34 that extend between the upstream and downstream surfaces 28, 30. The downstream surface 30 may be stepped in various directions or patterns. For example, the stepped shape of the downstream surface 30 may be concave, resulting in shorter tubes 34 towards the center of the tube bundle 36, as shown in FIGS. 5-7. Alternately, the stepped shape of the downstream surface 30 may be convex, resulting in shorter tubes 34 towards the outer perimeter of the tube bundle 36, as shown in FIG. 8. In still further embodiments, the stepped shape of the downstream surface 30 may be both concave and convex, resulting in shorter tubes 34 towards the center and outer perimeter of the tube bundle 36, as shown in FIG. 9.

In the particular embodiment shown in FIG. 5, the shroud 38 circumferentially surrounds the upstream and downstream surfaces 28, 30 to define a fuel plenum 52 inside the tube bundle 36 between the upstream and downstream surfaces 28, 30. A fuel conduit 54 may extend from the casing 12 and/or end cover 14 through the upstream surface 28 to provide fluid communication for fuel to flow into the fuel plenum 52. One or more of the tubes 34 may include a fuel port 56 that provides fluid communication from the fuel plenum 52 through the one or more tubes 34. The fuel ports 56 may be angled radially, axially, and/or azimuthally to project and/or impart swirl to the fuel flowing through the fuel ports 56 and into the tubes 34. The working fluid may thus flow into the tubes 34, and fuel from the fuel plenum 52 may flow around the tubes 34 in the fuel plenum 52 to provide convective cooling to the tubes 34 before flowing through the fuel ports 56 and into the tubes 34 to mix with the working fluid. The fuel-working fluid mixture may then flow through the tubes 34 and into the combustion chamber 26. The different axial lengths of the tubes 34 produced by the stepped downstream surface 30 decouple the natural frequency of the combustion dynamics, tailor flow instabilities downstream from the downstream surface 30, and/or axially distribute the combustion flame across the downstream surface 30 of the tube bundles 36 to reduce $NO_x$ production.

As further shown in FIG. 5, the tube bundle 36 may further include a thermal barrier coating 58 along at least a portion of the downstream surface 30. The thermal barrier coating 58 may include one or more of the following characteristics: low emissivity or high reflectance for heat, a smooth finish, and good adhesion to the underlying downstream surface 30. For example, thermal barrier coatings known in the art include metal oxides, such as zirconia ($ZrO_2$), partially or fully stabilized by yttria ($Y_2O_3$), magnesia (MgO), or other noble metal oxides. The selected thermal barrier coating 58 may be deposited by conventional methods using air plasma spraying (APS), low pressure plasma spraying (LPPS), or a physical vapor deposition (PVD) technique, such as electron beam physical vapor deposition (EBPVD), which yields a strain-tolerant columnar grain structure. The selected thermal barrier coating 58 may also be applied using a combination of any of the preceding methods to form a tape which is subsequently transferred for application to the underlying substrate, as described, for example, in U.S. Pat. No. 6,165,600, assigned to the same assignee as the present invention.

FIG. 6 provides an enlarged cross-section view of the tube bundle 36 according to a second embodiment of the present invention. The tube bundle 36 again includes the upstream surface 28, downstream surface 30, plurality of tubes 34, shroud 38, fuel plenum 52, fuel conduit 54, and fuel ports 56 as previously described with respect to the embodiment shown in FIG. 5. As shown in this particular embodiment, one or more of the tubes 34 includes an extension 60 or protrusion downstream from the downstream surface 30. The tube extensions 60 or protrusions further assist in modifying flow instabilities downstream from the downstream surface 30 in the combustion chamber 26.

FIG. 7 provides an enlarged cross-section view of the tube bundle 36 according to a third embodiment of the present invention. The tube bundle 36 again includes the upstream surface 28, downstream surface 30, plurality of tubes 34, shroud 38, fuel plenum 52, fuel conduit 54, and fuel ports 56 as previously described with respect to the embodiments shown in FIGS. 5 and 6. In addition, a barrier 62 extends radially inside the tube bundle 36 between the upstream and downstream surfaces 28, 30 to separate the fuel plenum 52 from a diluent plenum 64 inside the tube bundle 36. A diluent conduit 66 may extend from the casing 12 and/or end cover 14 through the upstream surface 28 separately from the fuel conduit 54 or coaxially with the fuel conduit 54, as shown in FIG. 7, to provide fluid communication for a diluent to flow into the diluent plenum 64. Suitable diluents include, for example, water, steam, combustion exhaust gases, and/or an inert gas such as nitrogen. A plurality of diluent ports 68 through the downstream surface 30 provides fluid communication from the diluent plenum 64 through the downstream surface 30. As shown in FIG. 7, the diluent ports 68 may be aligned parallel to, perpendicular to, or at various angles with respect to the fluid flow through the tubes 34. In this manner, the working fluid and fuel may thus flow through the tubes 34 and into the combustion chamber 26, as previously described. In addition, diluent from the diluent conduit 64 may flow around the tubes 34 to provide convective cooling to the tubes 34 in the diluent plenum 64 before flowing through the diluent ports 68 to cool the downstream surface 30 adjacent to the combustion chamber 26. In addition to cooling the downstream surface 30, the diluent supplied through the downstream surface 30 further assists in decoupling the natural frequency of the combustion dynamics, tailoring flow instabilities, and/or axially distributing the combustion flame across the downstream surface 30 of the tube bundles 36 to reduce NOx production.

FIG. 8 provides an enlarged cross-section view of the tube bundle 36 according to a fourth embodiment of the present invention. This particular embodiment generally represents a combination of the embodiments previously described and illustrated with respect to FIGS. 6 and 7. As a result, the tube bundle 36 includes the upstream surface 28, downstream surface 30, plurality of tubes 34, shroud 38, fuel plenum 52, fuel conduit 54, fuel ports 56, tube extensions 60, barrier 62, diluent plenum 64, diluent conduit 66, and diluent ports 68 as previously described with respect to the embodiments shown in FIGS. 6 and 7. As shown in this particular embodiment, the stepped shape of the downstream surface 30 is convex, with the shorter axial lengths between the upstream and downstream surfaces 28, 30 towards the perimeter of the tube bundle 36.

FIG. 9 provides an enlarged cross-section view of the tube bundle 36 according to a fifth embodiment of the present invention. This particular embodiment generally represents a combination of the embodiments previously described and illustrated with respect to FIGS. 5 and 7. As a result, the tube bundle 36 includes the upstream surface 28, downstream surface 30, plurality of tubes 34, shroud 38, fuel plenum 52, fuel conduit 54, fuel ports 56, thermal barrier coating 58, barrier 62, diluent plenum 64, and diluent ports 68 as previously described with respect to the embodiments shown in FIGS. 5 and 7. As shown in this particular embodiment, the stepped shape of the downstream surface 30 is both concave and convex, resulting in shorter tubes 34 towards the center and outer perimeter of the tube bundle 36, as shown in FIG. 9. In addition, diluent passages 70 provide fluid communication through the shroud 38 to the diluent plenum 64. In this manner, the working fluid and fuel may thus flow through the tubes 34 and into the combustion chamber 26, as previously described. In addition, diluent or working fluid may flow through the diluent passages 70 and around the tubes 34 to provide convective cooling to the tubes 34 in the diluent plenum 64 before flowing through the diluent ports 68 to cool the downstream surface 30 adjacent to the combustion chamber 26. In addition to cooling the downstream surface 30, the diluent or working fluid supplied through the downstream surface 30 further assists in decoupling the natural frequency of the combustion dynamics, tailoring flow instabilities, and/or axially distributing the combustion flame across the downstream surface 30 of the tube bundles 36 to reduce $NO_x$ production.

The various embodiments described and illustrated with respect to FIGS. 1-9 may also provide a method for reducing combustion dynamics and $NO_x$ in the combustor 10. The method generally includes flowing the working fluid and/or fuel through the tubes 34 radially arranged between the upstream surface 28 and the stepped downstream surface 30. The method may further include flowing diluent through diluent ports in the downstream surface and/or flowing fuel through a tube bundle 36 aligned with the axial centerline 42 of the end cap 24.

The systems and methods described herein may provide one or more of the following advantages over existing nozzles and combustors. Specifically, the different axial lengths of the tubes 34, tube extensions 60, and/or diluent ports 68, alone or in various combinations may decouple the natural frequency of the combustion dynamics, tailor flow instabilities, and/or axially distribute the combustion flame across the downstream surface 30 of the tube bundles 36 to reduce $NO_x$ production.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A system for reducing combustion dynamics and $NO_x$ in a combustor, comprising:

a. a tube bundle that extends radially across at least a portion of the combustor, wherein the tube bundle comprises an upstream surface axially separated from a downstream surface;

b. a shroud that circumferentially surrounds the upstream and downstream surfaces; and c. a plurality of tubes that extends through the tube bundle from the upstream surface through the downstream surface, wherein the downstream surface is stepped to prevent flame interaction between tubes and to produce tubes having different lengths through the tube bundle;

d. wherein the upstream surface, the downstream surface and the shroud define a fuel plenum, wherein each tube of the plurality of tubes is in fluid communication with the fuel plenum.

2. The system as in claim 1, wherein a first set of the plurality of tubes extends downstream from the downstream surface.

3. The system as in claim 1, further comprising a plurality of tube bundles radially arranged in the combustor.

4. The system as in claim 1, further comprising a thermal harrier coating along at least a portion of the downstream surface.

5. The system as in claim 1, further comprising a barrier that extends radially inside the tube bundle between the upstream and downstream surfaces to separate a fuel plenum from a diluent plenum inside the tube bundle.

6. The system as in claim 5, further comprising a plurality of diluent ports through the downstream surface, wherein the plurality of diluent ports provides fluid communication from the diluent plenum through the downstream surface.

7. The system as in claim 5, further comprising a plurality of fuel ports through the plurality of tubes, wherein the plurality of fuel ports provides fluid communication from the fuel plenum through the plurality of tubes.

8. The system as in claim 1, wherein the downstream surface is stepped such that a first tube of the plurality of tubes has a first axial length and a second tube of the plurality of tubes which is spaced radially outwardly from the first tube has a second axial length, wherein the first axial length is less than the second axial length.

9. A system for reducing combustion dynamics and $NO_x$ in a combustor, comprising:

a. an end cap that extends radially across at least a portion of the combustor, wherein the end cap comprises an upstream surface and a stepped downstream surface axially separated from the upstream surface;

b. a cap shield that circumferentially surrounds the upstream and downstream surfaces, wherein the cap shield, the upstream surface and the downstream surface define a fuel plenum within the end cap;

c. a plurality of tubes that extends through the end cap from the upstream surface, through the fuel plenum and terminate at the stepped downstream surface, wherein two or more of the tubes of the plurality of tubes have different axial lengths, wherein at least one tube of the plurality of tubes is in fluid communication with the fuel plenum.

10. The system as in claim 9, wherein a first set of the plurality of tubes extends downstream from the stepped downstream surface.

11. The system as in claim 9, wherein the plurality of tubes is arranged in a plurality of tube bundles radially arranged in the end cap.

12. The system as in claim 9, further comprising a thermal barrier coating along at least a portion of the stepped downstream surface.

13. The system as in claim 9, further comprising a barrier that extends radially inside the end cap between the upstream surface and the stepped downstream surface to separate a fuel plenum from a diluent plenum inside the end cap.

14. The system as in claim 13, further comprising a plurality of diluent ports through the stepped downstream surface, wherein the plurality of diluent ports provides fluid communication from the diluent plenum through the stepped downstream surface.

15. The system as in claim 13, further comprising a plurality of fuel ports through the plurality of tubes, wherein the plurality of fuel ports provides fluid communication from the fuel plenum through the plurality of tubes.

16. The system as in claim 9, wherein the stepped downstream surface is stepped such that a first tube of the plurality of tubes has a first axial length and a second tube of the plurality of tubes which is spaced radially outwardly from the first tube has a second axial length, wherein the first axial length is greater than the second axial length.

17. A method for reducing combustion dynamics and NOx, in a combustor, comprising:

a. flowing a working fluid through a plurality of tubes radially arranged between an upstream surface and a downstream surface of an end cap that extends radially across at least a portion of the combustor;

b. injecting a fuel from a fuel plenum into the tubes, wherein the tubes extend axially through the fuel plenum, wherein the fuel plenum is at least partially defined between the upstream and downstream surfaces and wherein the downstream surface of the end cap is stepped to produce tubes having different axial lengths.

18. The method as in claim 17, further comprising flowing a diluent through diluent ports in the downstream surface.

* * * * *